US006102666A

United States Patent [19]

Albrecht

[11] Patent Number: 6,102,666

[45] Date of Patent: Aug. 15, 2000

[54] SEALED ELECTRICAL CONNECTOR ASSEMBLY

[75] Inventor: Eric H. Albrecht, San Antonio, Tex.

[73] Assignee: U.S. Natural Resources, Inc., San Antonio, Tex.

[21] Appl. No.: 09/221,769

[22] Filed: Dec. 28, 1998

[51] Int. Cl.[7] ..... F04B 49/10

[52] U.S. Cl. ..... 417/32

[58] Field of Search ..... 417/32; 439/27

[56] References Cited

U.S. PATENT DOCUMENTS

| | | |
|---|---|---|
| 2,720,636 | 10/1955 | McKinley . |
| 3,160,460 | 12/1964 | Wyzenbeek . |
| 3,850,496 | 11/1974 | Hague . |
| 4,456,320 | 6/1984 | Gallusser et al. . |
| 5,035,653 | 7/1991 | Honkomp et al. . |
| 5,145,417 | 9/1992 | Honkomp et al. . |
| 5,199,898 | 4/1993 | Wisner . |
| 5,336,105 | 8/1994 | Wisner . |
| 5,393,242 | 2/1995 | VanDerStuyf . |
| 5,580,282 | 12/1996 | Paterek . |
| 5,664,959 | 9/1997 | Duell et al. . |

FOREIGN PATENT DOCUMENTS

| | | |
|---|---|---|
| 489186 | 10/1974 | Australia . |
| 512077 | 6/1957 | Italy . |

*Primary Examiner*—Teresa Walberg
*Assistant Examiner*—Vinod D Patel
*Attorney, Agent, or Firm*—Gunn, Lee & Keeling

[57] ABSTRACT

A compressor apparatus includes a compressor housing having a mating surface with at least one electrical terminal associated therewith. An electrical connector assembly includes a hermetically sealed body having an axial face configured to lie adjacent to the mating surface of the compressor housing. A first electrical connector is molded substantially within the body. The first electrical connector is for connection with a source of electrical power. The first electrical connector is in communication with the axial face of the body. The first electrical connector is configured for connection to the at least one compressor terminal. A second electrical connector is substantially molded within the body. The second electrical connector is in communication with the axial face of the body. A thermal cutoff device is electrically and removably connected to the second electrical connector. At least one closed-loop seal substantially seals the at least one compressor terminal, the first electrical connector, the second electrical connector and the thermal cutoff device from an ambient environment.

13 Claims, 2 Drawing Sheets

SEALED ELECTRICAL CONNECTOR ASSEMBLY

BACKGROUND OF THE INVENTION

1. Field of the Invention

The present invention relates to electrical connector assemblies, and, more particularly, to electrical connector assemblies for a compressor, such as used in a refrigerator.

2. Description of the Related Art

Electrical connector assemblies are used to supply power to a compressor. A compressor is typically surrounded by a housing having three terminals corresponding to run, common and start. An electrical connector mates with each of the three terminals of the compressor housing, electrically connecting each of the three terminals to respective wires leading to the run, common or start from a power supply.

It is known to provide such an electrical connector with a plastic body in order to protect the terminals and the connector from physical damage, to protect them from moisture in the ambient environment, and to electrically insulate the terminals and connectors, mainly for the safety of the user.

It is also known to provide the compressor housing with an embossed flat surface that is sized to receive the plastic body of the electrical connector. The recess can be circular, having an inside diameter slightly larger than the outside diameter of a circular electrical connector body. A gasket can be placed between the embossed flat surface of the compressor housing and the bottom surface of the connector body in order to seal the terminals and connector from outside moisture.

A problem is that a given electrical connector assembly is compatible only with a compressor housing that has dimensions that allow the compressor housing to mate with the electrical connector assembly. For example, an electrical connector assembly with a given outside diameter may only be connected to a compressor housing having an embossed flat surface with a slightly larger inside diameter.

What is needed in the art is a sealed electrical connector assembly which can be attached in a substantially watertight manner to a compressor housing having a smooth, substantially flat or slightly rounded surface of any size or shape.

SUMMARY OF THE INVENTION

The present invention relates to a sealed electrical connector assembly which can be connected in a water tight manner to terminals projecting from a smooth surface of a compressor housing of substantially any size or shape.

The invention comprises, in one form thereof, a compressor apparatus including a compressor housing. The compressor housing has a mating surface with at least one electrical terminal associated therewith. An electrical connector assembly includes a hermetically sealed body having an axial face configured to lie adjacent to the mating surface of the compressor housing. A first electrical connector is molded substantially within the body. The first electrical connector is for connection with a source of electrical power. The first electrical connector is in communication with the axial face of the body. The first electrical connector is configured for connection to the at least one compressor terminal. A second electrical connector is substantially molded within the body. The second electrical connector is in communication with the axial face of the body. A thermal cutoff device is electrically and removably connected to the second electrical connector. At least one closed-loop seal is disposed between the compressor housing mating surface and the axial face of the assembly body. The at least one closed-loop seal substantially seals the at least one compressor terminal, the first electrical connector, the second electrical connector and the thermal cutoff device from an ambient environment.

An advantage of the present invention is that a single electrical connector assembly can be attached to any of a large number of compressor housings having a wide variety of sizes and shapes.

Another advantage is that the electrical connectors within the electrical connector assembly are hermetically sealed from the ambient environment.

Yet another advantage is that the electrical connector assembly can hermetically seal the terminals of differently sized compressor housings from the ambient environment.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
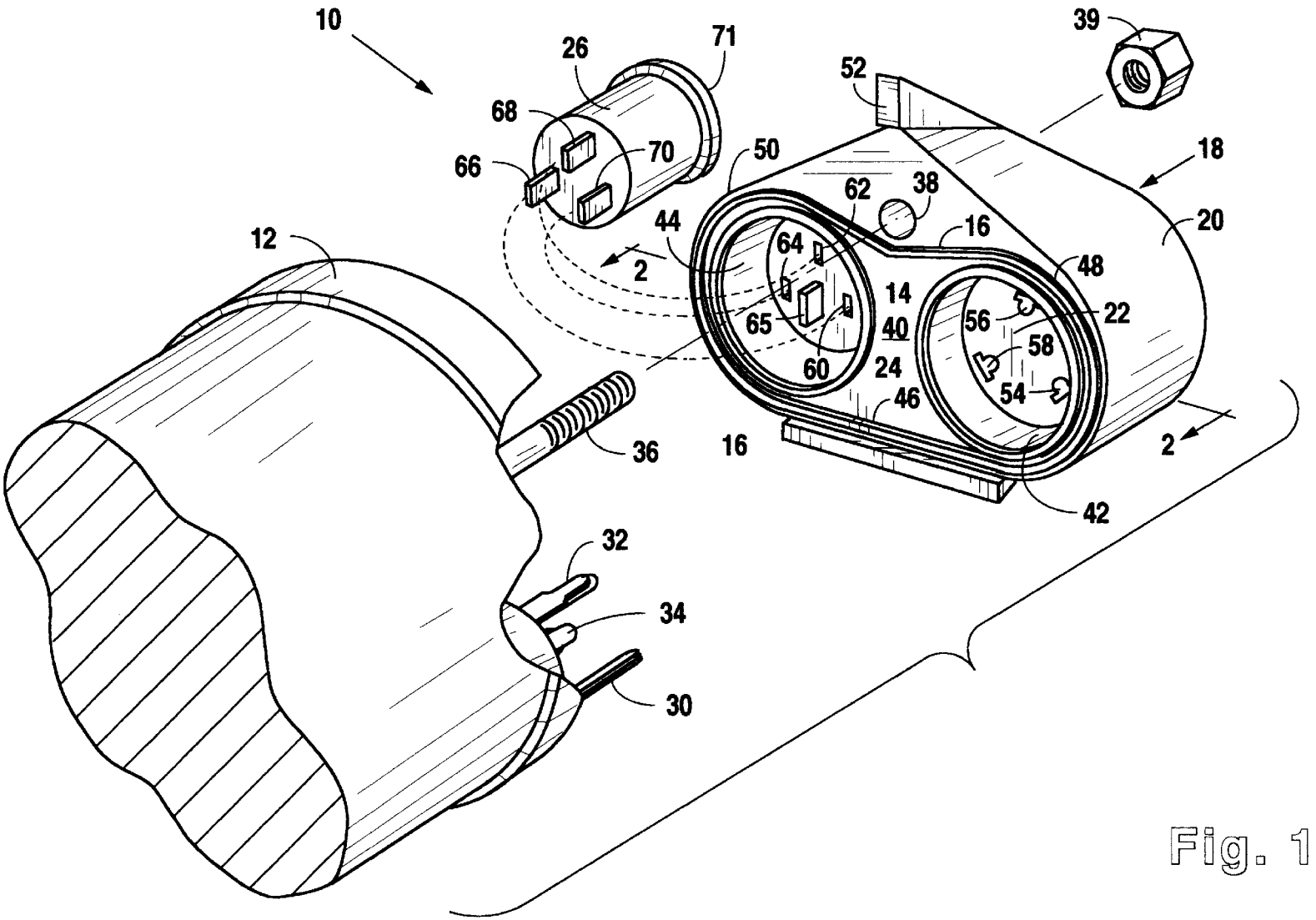
FIG. 1 is an exploded, perspective view of an embodiment of the compressor apparatus of the present invention.

Referring now to the drawings, and more particularly to FIG. 1, there is shown a perspective view of an embodiment of a compressor apparatus 10 of the present invention. Compressor apparatus 10 generally includes a compressor housing 12 and an electrical connector assembly 18.

Figure 2:
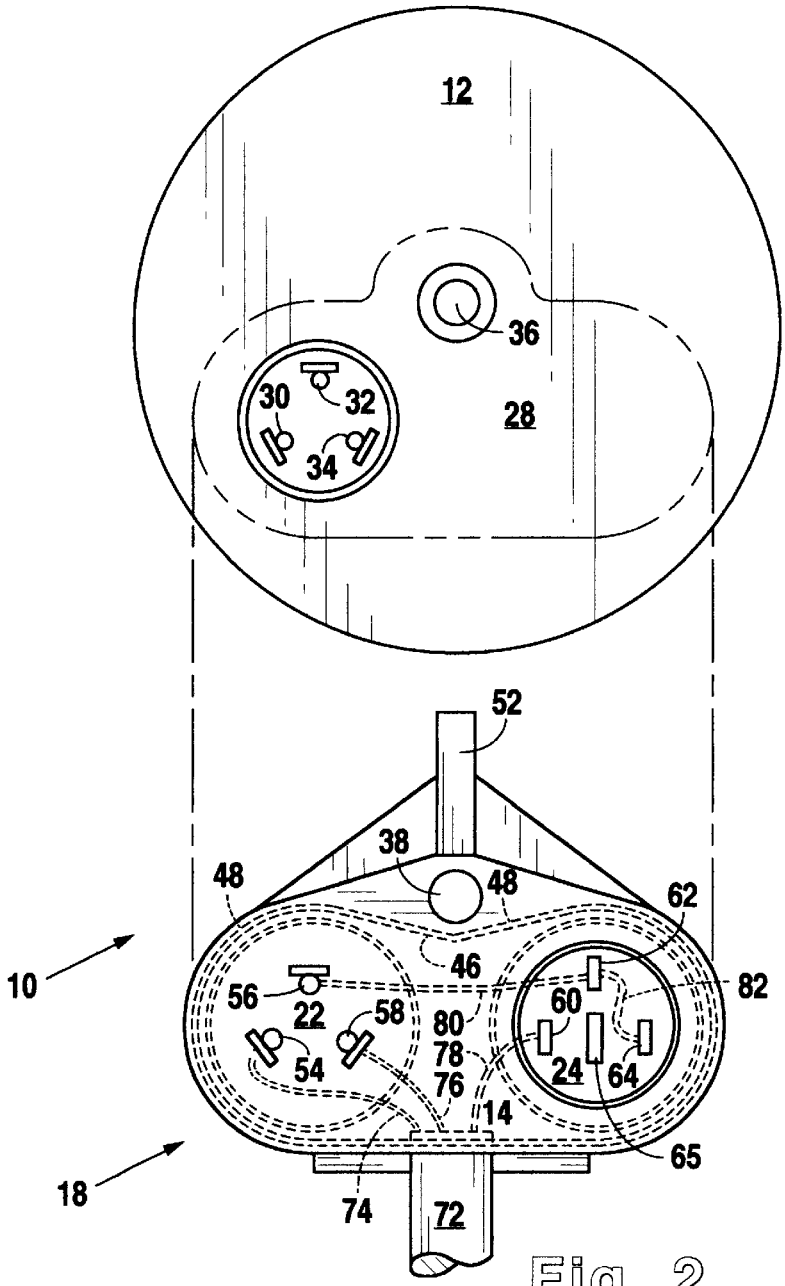
FIG. 2 is a top sectional, fragmentary view of the compressor apparatus of FIG. 1.

Compressor housing 12 includes a smooth, substantially flat or slightly rounded mating surface 28 (FIG. 2) having three electrical terminals 30, 32 and 34 projecting therefrom. Electrical power is supplied to the compressor through terminals 30, 32 and 34, corresponding to run, common and start, respectively. A threaded post 36 is also included in mating surface 28 of compressor housing 12.

Figure 3:
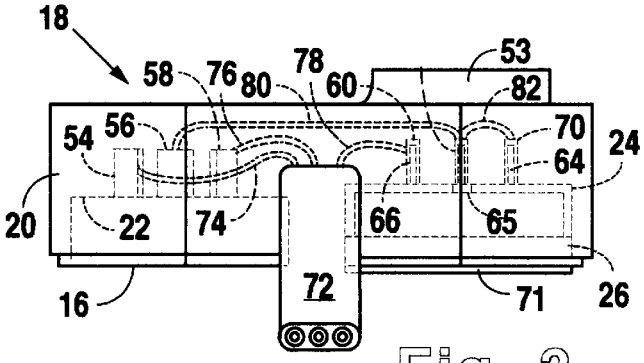
FIG. 3 is a side, sectional view of the electrical connector assembly of the compressor apparatus of FIG. 1.

Electrical connector assembly 18 includes a plastic molded body 20, a first electrical connector 22, a second electrical connector 24, a thermal cutoff (TCO) 26, an inner seal 14 and an outer seal 16. Body 20 of electrical connector assembly 18 includes a through hole 38 through which threaded post 36 may be inserted and secured therein by a nut 39, thereby attaching connector assembly 18 to compressor housing 12. Body 20 also includes a substantially flat axial face 40 having an orifice 42 for receiving terminals 30, 32 and 34. Orifice 42 has an inside diameter which is large enough to accommodate slight tipping or TCO 26. Axial face 40 of body 20 also includes a recess or cavity 44 for receiving thermal cutoff (TCO) 26. Etched into axial face 40 is an inner groove 46 and an outer groove 48 for receiving inner seal 14 and outer seal 16, respectively. Inner groove 46 surrounds each of recess 44 and orifice 42. Outer groove 48 surrounds inner groove 46 and is disposed substantially adjacent to a periphery 50 of axial face 40. Body 20 includes a foot 52 which acts as a cantilever when connector assembly 18 is mated to compressor housing 12. Body 20 also includes a raised area 53 (FIG. 3) providing extra clearance room for wires connected to TCO 26, which wires will be discussed in more detail hereinafter.

First electrical connector 22 includes line contacts 54, 56 and 58 which connect with compressor terminals 30, 32 and 34, respectively, through orifice 42. These compressor terminals represent connections to the start, run and common of the compressor motor windings. Second electrical connector 24 includes individual contacts 60, 62 and 64 which electrically connect with TCO 26. Contacts 60, 62 and 64 are slightly flexible to allow for slight movement of TCO 26 within recess 44 and with respect to body 20. Second electrical connector 24 includes a flexible rib 65 for biasing TCO 26 out of recess 44, and, as will be described in more detail hereinafter, against mating surface 28 of housing 12.

TCO 26 includes two blades 66 and 68 through which TCO 26 is removably connected to connector 24. Blades 66 and 68 electrically connect with contacts 60 and 62, respectively, of second electrical connector 24. TCO 26 interconnects blades 66 and 68. A bimetallic element within TCO 26 opens a pair of switch contacts when compressor mating surface 28 reaches a predetermined temperature, or the current passing through the TCO 26 causes the element to reach a predetermined temperature, the temperature and current being dependent upon the particular TCO used. When the switch contacts open, power is cut off from contact 62, and thus also from line contact 56 and the compressor. When the temperature of compressor mating surface 28 again falls below the predetermined temperature, the bimetallic element again closes the pair of switch contacts, restoring power to the compressor. Thus, TCO 26 functions as a switch which opens and closes at a predetermined temperature. Alternatively, another type of TCO 26 which includes a blade 70 (shown in phantom lines) instead of blade 68 may be used. Blade 70 electrically connects with contact 64 of second electrical connector 24. The bimetallic element within TCO 26 interconnects blades 66 and 70, and is connected in series with a heating resistor. The heating resistor acts as an amplifier to speed up the response of the TCO 26.

TCO 26 also includes a smooth, substantially flat or slightly rounded bottom face 71 which conforms to contact mating surface 28 as much as possible. TCO 26 has a diameter slightly smaller than that of recess 44, allowing TCO 26 to tilt relative to body 20, thereby maximizing the conformance of bottom face 71 to mating surface 28. Bottom face 71 is pressed against mating surface 28 under the biasing effect of flexible rib 65 of second electrical connector 24.

A wire conduit 72 contains wires 74, 76 and 78 which carry electrical power from a source of electrical power such as a system switch or contactor of the product (not shown) to connector assembly 18. Wire conduit 72 is overmolded into body 20. Wire 74 and wire 76 are electrically connected to compressor run and start terminals 54 and 58, respectively, of first electrical connector 22. Line wire 78 is connected to contact 60, associated with TCO 26, and can be connected to first electrical connector 22 by a second line wire 80 interconnecting contact 62 and compressor common terminal 56. A jumper wire 82 interconnects contacts 62 and 64 of second electrical connector 24, connecting line wire 78 with first electrical connector 22 when blade 70 is present instead of blade 68. Each of wires 74-82 can be at least partly molded within body 20.

Inner seal 14 is substantially compressible and is formed in a closed-loop. Inner seal 14 is received within inner groove 46 of axial face 40 such that inner seal 14 substantially seals terminals 30–34, first connector 22, second connector 24 and TCO 26 from the ambient environment when electrical connector assembly 18 is mated with compressor housing 12.

Outer seal 16 is also substantially compressible and formed in a closed loop, but outer seal 16 could also be substantially rigid. Outer seal 16 is received within outer groove 48 of axial face 40, enabling outer seal 16 to function as a backup to inner seal 14. Thus, outer seal 16 substantially seals inner seal 14 from the ambient environment. Inner seal 14 and outer seal 16 are each pressed between axial face 40 and mating surface 28 of compressor housing 12. Thus, due to both the molded construction of body 20 and the effect of seals 14 and 16, body 20 is hermetically sealed from the outside ambient when mated with compressor housing 12.

Seals 14 and 16 enable connector assembly 18 to be hermetically sealed from the outside ambient against a compressor housing having a smooth and substantially flat or slightly curved surface of nearly any size or shape. The main requirement for a hermetic seal is that the compressor housing mating surface include a smooth, substantially planar or slightly rounded surface with which seals 14 and 16 may interface.

During use, TCO 26 absorbs heat from mating surface 28 of compressor housing 12. TCO 26 switches OFF power to, or breaks the circuit to line terminal 32 when the temperature of TCO 26 exceeds a predetermined level. In this way, TCO 26 prevents the compressor from overheating. TCO 26 can also reclose the circuit to line terminal 32 when the TCO temperature falls below the predetermined level. If desired, TCO 26 can be removed and replaced with a TCO having a different predetermined switching temperature. Thus, the user can select a TCO which will prevent compressor operation at any desired temperature and current load, and reset for operation at a much lower temperature condition to suit the particular application.

In another embodiment (not shown), a single continuous line wire is directly connected to compressor common terminal 56, while a line wire 80 is connected to compressor run terminal 54 through TCO 26. TCO 26 thus may prevent the compressor from running through the run terminal rather than through the common terminal.

In yet another embodiment (not shown), post 36 and through hole 38 are disposed within the loop of inner seal 14. In this embodiment, another seal can be placed between post 36 and the top of body 20 in order to prevent moisture from entering body 20 along post 36. Alternatively, instead of post 36 and through hole 38, electrical connector assembly 18 can be secured to compressor housing 12 by one or more springs interconnecting and biasing together the two components.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor apparatus, comprising:

a compressor housing having a mating surface with at least one electrical terminal associated therewith; and an electrical connector assembly including:

a hermetically sealed body having an axial face adjacent to said mating surface of said compressor housing;

a first electrical connector molded substantially within said body, said first electrical connector being for connection with a source of electrical power, said first electrical connector being electrically connected to said at least one compressor terminal, said first electrical connector being in communication with said axial face of said body;

a second electrical connector molded substantially within said body, said second electrical connector being in communication with said axial face of said body;

a thermal cutoff device electrically and removably connected to said second electrical connector; and at least one closed-loop seal disposed between said compressor housing mating surface and said axial face of said assembly body, said at least one closed-loop seal substantially sealing said at least one compressor terminal, said first electrical connector, said second electrical connector, and said thermal cutoff device from an ambient environment.

2. An electrical connector assembly for a compressor housing having a mating surface with at least one electrical terminal associated therewith, said electrical connector assembly comprising:

a hermetically sealed body including an axial face configured to lie adjacent to the mating surface of the compressor housing;

a first electrical connector molded substantially within said body, said first electrical connector being for connection with a source of electrical power, said first electrical connector being in communication with said axial face of said body, said first electrical connector being configured for connection to the at least one compressor terminal;

a second electrical connector substantially molded within said body, said second electrical connector being in communication with said axial face of said body;

a thermal cutoff device electrically and removably connected to said second electrical connector; and at least one closed-loop seal disposed between the compressor housing mating surface and said axial face of said assembly body, said at least one closed-loop seal substantially sealing the at least one compressor terminal, said first electrical connector, said second electrical connector, and said thermal cutoff device from an ambient environment.

3. The electrical connector assembly of claim 2, wherein said at least one closed-loop seal comprises:

a substantially compressible closed-loop inner seal substantially sealing the at least one compressor terminal, said first electrical connector, said second electrical connector, and said thermal cutoff device from the ambient environment; and a closed-loop outer seal substantially sealing said inner seal from the ambient environment.

4. The electrical connector assembly of claim 3, wherein said axial face has an inner groove for receiving said inner seal and an outer groove for receiving said outer seal.

5. The electrical connector assembly of claim 2, further comprising at least one first conductor electrically connected to said first electrical connector, said at least one first conductor extending outside said body.

6. The electrical connector assembly of claim 5, further comprising at least one second conductor electrically interconnecting said first electrical connector and said second electrical connector.

7. The electrical connector assembly of claim 6, further comprising at least one third conductor electrically connected to said second electrical connector and extending outside said body.

8. The electrical connector assembly of claim 7, wherein said at least one first conductor and said at least one third conductor are configured for connection to the source of electrical power.

9. The electrical connector assembly of claim 7, wherein each of said at least one first conductor, said at least one second conductor and said at least one third conductor is at least partly molded within said body.

10. The electrical connector assembly of claim 2, wherein said axial face includes a recess configured for receiving said thermal cutoff device.

11. The electrical connector assembly of claim 10, wherein said thermal cutoff device is removable through said recess.

12. The electrical connector assembly of claim 2, wherein said thermal cutoff device is configured for interrupting electrical power from the source of electrical power to the at least one compressor terminal.

13. The electrical connector assembly of claim 2, wherein said thermal cutoff device defines a means for interrupting electrical power from the source of electrical power to the at least one compressor terminal.

* * * * *